United States Patent [19]

Hara et al.

[11] 4,130,997

[45] Dec. 26, 1978

[54] REFRIGERATOR

[75] Inventors: Toshitsugu Hara, Tokyo; Yoritsune Abe; Katsuji Ootuka, both of Tochigi; Yasushige Kashiwabara, Musashino; Hiroichi Oshiyama, Nagareyama; Michio Yanadori, Hachioji; Eisaku Kato, Tochigi; Kichizaemon Okazaki, Yokohama, all of Japan

[73] Assignee: Hitachi, Ltd., Japan

[21] Appl. No.: 748,504

[22] Filed: Dec. 8, 1976

[30] Foreign Application Priority Data

Dec. 10, 1975 [JP] Japan ..... 50/146437

[51] Int. Cl.[2] ..... F25B 39/02; F25B 43/00

[52] U.S. Cl. ..... 62/504; 62/512

[58] Field of Search ..... 62/504, 199, 335, 525, 62/503, 527, 528, 512, 476, 148

[56] References Cited

U.S. PATENT DOCUMENTS

| | | | |
|---|---|---|---|
| 2,640,327 | 6/1953 | Alsing | 62/512 |
| 2,750,757 | 6/1956 | Zearfoss, Jr. | 62/504 |
| 2,780,072 | 2/1957 | Warner | 62/504 |
| 2,871,679 | 2/1959 | Zearfoss, Jr. | 62/504 |
| 3,067,590 | 12/1962 | Wood, Jr. | 62/512 |
| 3,081,607 | 3/1962 | Reber, Jr. | 62/504 |
| 3,680,324 | 8/1972 | Garland | 62/512 |

*Primary Examiner*—Lloyd L. King

*Attorney, Agent, or Firm*—Craig & Antonelli

[57] ABSTRACT

A refrigerator comprises a refrigerating cycle in which a refrigerant is charged and which includes a cooler for a freezing compartment, a closed loop which is branched from the refrigerating cycle and includes a cooler for a refrigerating compartment, and a heating device provided in the closed loop which supplies the refrigerant to the closed loop by means of vapor bubble pumping action, to thereby control the refrigerant flow in the closed loop.

11 Claims, 7 Drawing Figures

REFRIGERATOR

BACKGROUND OF THE INVENTION

1. Field of the Invention

The present invention relates to a refrigerator having a plurality of compartments such as a freezing compartment and a refrigerating compartment in which the temperatures are mutually different.

2. Description of the Prior Art

In a prior art refrigerator having two compartments, that is, a freezing compartment and a refrigerating compartment, there are provided a separate cooler for the freezing compartment and a separate cooler for the refrigerating compartment in order to independently cool these two compartments. Furthermore, an electromagnetic valve is provided in a connection tube connecting these two coolers. In the refrigerator, the flow rate of a refrigerant (working fluid) flowing in the respective coolers is controlled by the regulation of the electromagnetic valve.

However, in such a refrigerator, since there is provided a mechanical valve such as an electromagnetic valve having a moving part, it is almost impossible to achieve a long life time and high reliability and the cost of the valve is very expensive.

SUMMARY OF THE INVENTION

An object of the present invention is to provide a refrigerator having a long life time and high reliability.

Another object of the present invention is to provide a refrigerator which is inexpensive.

In order to achieve such objects, the present invention is characterized by providing a refrigerating cycle in which the refrigerant is charged and which includes a first cooling section, at least one closed loop which is branched from the refrigerating cycle and which includes a second cooling section, and heating means provided in the closed loop which supplies the refrigerant to the closed loop by means of a vapor bubble pumping action, to thereby control the refrigerant flow in the closed loop.

DETAILED DESCRIPTION OF THE PREFERRED EMBODIMENTS

Figure 1:
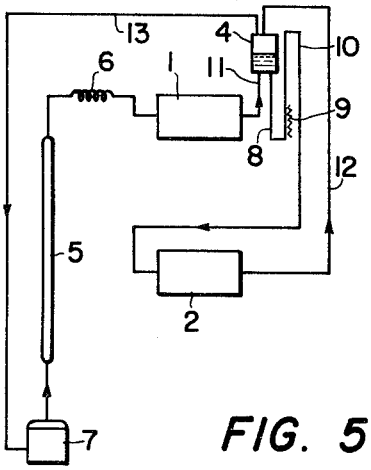
FIG. 1 is a diagram showing an embodiment of a refrigerator according to the present invention.

Referring to FIG. 1, numeral 1 designates a cooler for a freezing compartment, numeral 2 a cooler for a refrigerating compartment, numeral 4 a liquid tank such as an accumulator, numeral 5 a radiator, numeral 6 a pressure regulator such as an expansion valve, a capillary tube, etc., numeral 7 a compressor, numeral 8 a connecting tube, numeral 9 a heating device such as an electric heater, a hot air blower, a Peltier element, electromagnetic heater, etc., numeral 10 an inverted U-type tube, numerals 11 and 13 connecting tubes, and numeral 12 a rising tube.

A refrigerating cycle is formed by the compressor 7, the radiator 5, the pressure regulator 6, the cooler 1, the connecting tube 11, the liquid tank 4 and the connecting tube 13. A closed loop branched from the liquid tank 4 of the refrigerating cycle is constituted by the connecting tube 8, the heating device 9, the inverted U-type tube 10, the cooler 2, the rising tube 12 and the liquid tank 4. The inverted U-type tube 10 is arranged so that the height of the tube 10 is higher than that of the liquid surface in the liquid tank 4 when the heating device 9 is not operated.

With such a construction, the refrigerant compressed by the compressor 7 is supplied to the radiator as a high temperature gas. This gas condenses in the radiator 5 and becomes a liquid refrigerant. After this liquid refrigerant is pressure-reduced by the pressure regulator 6, it is mostly evaporated by the cooler 1. The liquid refrigerant which cannot be evaporated by the cooler 1 is stored in the liquid tank 4 through the connecting tube 11. Only vapor refrigerant evaporated by the cooler 1 is fed back to the compressor 7. That is, the refrigerant is circulated in the refrigerating cycle.

On the other hand, the bottom of the liquid tank 4 is connected through the connecting tube 8 and the heating device 9 to the inverted U-type tube 10. This tube 10 is connected to the inlet of the cooler 2 for the refrigerating compartment. The outlet of the cooler 2 is connected through the rising tube 12 to the top of the liquid tank 4 as so to return the vapor refrigerant evaporated by the cooler 2 to the refrigerating cycle.

When the heating device 9 is not operated, the top surface of the liquid refrigerant is lower than the top of the tube 10. Therefore, the level of the liquid refrigerant cannot exceed the top of the tube 10 and cannot be supplied to the cooler 2. Thus, the cooling function of the cooler 2 is interrupted.

When the refrigerant in the tube 10 is heated by the operation of the heating device 9, vapor bubbles are generated by the boiling of the liquid refrigerant. The liquid refrigerant is pushed up by means of a pumping action caused by the rising of the vapor bubbles and overflows from the top of the tube 10. The overflowing liquid refrigerant is supplied to the cooler 2 and is evaporated therein. The heat absorbed by the cooler 2 is transmitted through the rising tube 12 and the liquid tank 4 to the refrigerating cycle.

The heating device 9 is operated so as to heat the refrigerant in the tube 10, for example, when the temperature in the refrigerating compartment detected by a temperature detector is higher than a predetermined temperature. The operation of the heating device 9 is interrupted, for example, when the temperature in the refrigerating compartment becomes lower than the predetermined temperature.

In response to the operation or the interruption of operation of the heating device 9, the supply of the refrigerant to the cooler 2 is initiated or interrupted, thereby controlling the cooling function.

According to our experiments, where fluorcarbon R-12 is used as the refrigerant and the inner diameter and the height of the tube 10 are 4mm and 200mm, respectively, and a heat power of 3W is supplied to the tube 10 by the operation of the heating device 9, a heat power of about 80W can be transmitted from the cooler 2 to the radiator 5. The temperature in the refrigerating compartment can be always controlled at 2° C. independent of the temperature (about −18° C.) of the freezing compartment.

Figure 2:
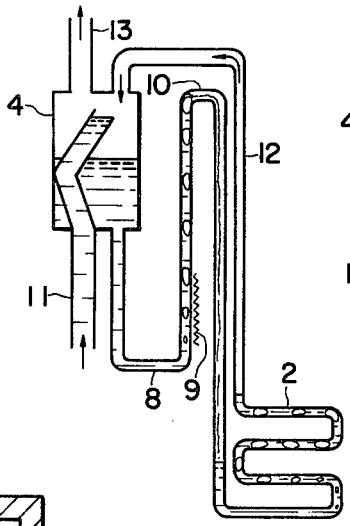
FIGS. 2 through 4 are diagrams showing examples of the concrete construction of a part of the refrigerator according to the present invention.

FIG. 2 shows an example of the concrete construction of a part of a refrigerator shown in FIG. 1. In FIG. 2 there is shown a condition where the heating device 9 is operated.

As is seen in FIG. 2, the liquid refrigerant is supplied to the cooler 2 by means of the pumping function of the vapor bubbles generated by the heating device 9.

Figure 3:
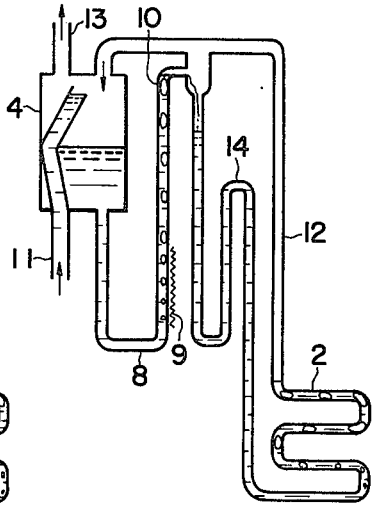

FIG. 3 shows another example of the concrete construction of a part of a refrigerator shown in FIG. 1.

In FIG. 3, the top of the inverted U-type tube 10 is connected to the rising tube 12 so that the pressure of the top of the liquid tank 4 coincides with that of the top of the tube 10. The vapor bubble pumping function is stably effected by the perfect pressure coincidence.

Furthermore, a liquid trap 14 is provided between the tube 10 and the cooler 2 to form a water head which overcomes the frictional resistance caused when the liquid refrigerant including the vapor bubbles flows in the cooler 2. The liquid trap 14 may be provided in the device shown in FIG. 2. The liquid trap 14 can also be removed from the arrangement shown in FIG. 3.

Figure 4:
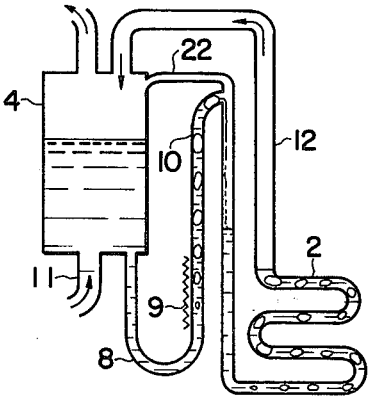

FIG. 4 shows another example of a concrete construction of a part of a refrigerator shown in FIG. 1.

In FIG. 4, a pressure equalizing tube 22 is provided between the top of the liquid tank 4 and the inverted U-type tube 10, in order to equalize the pressure in the top part of the tube 10 to the pressure in the liquid tank 4.

As compared with the embodiment shown in FIG. 3 in which the top of the tube 10 is connected to the rising tube 12, that shown in FIG. 4, in which the liquid tank 4 and the top of the tube 10 are connectd by the tube 22, has features that the actual welding for the connection therebetween is easily effected and the pressure of the top of the tube 10 effectively coincides with the inner pressure of the liquid tank 4.

A thin tube or a capillary tube may be used as the pressure equalizing tube 22. Furthermore, a liquid trap as shown in FIG. 3 may be arranged in the device shown in FIG. 4.

Figure 5:
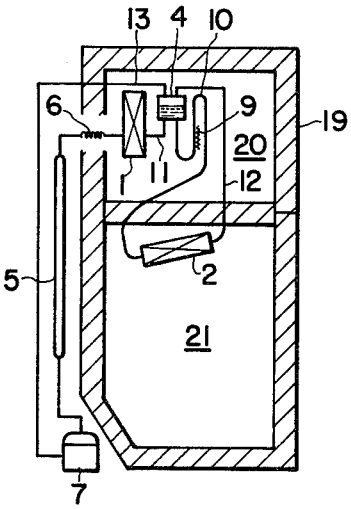
FIG. 5 is a diagram showing an embodiment of the overall construction of a refrigerator according to the present invention.

FIG. 5 shows an embodiment of the overall construction of a refrigerator according to the present invention.

In FIG. 5, two compartments, that is, a freezing compartment 20 and a refrigerating compartment 21 are constructed by a frame 19. The coolers 1 and 2 are arranged in the freezing compartment 20 and the refrigerating compartment 21, respectively. The radiator 5 and the compressor 7 are arranged outside the frame 19. The constructions of the refrigeration cycle and the closed loop are the same as that of FIG. 1.

Figure 6:
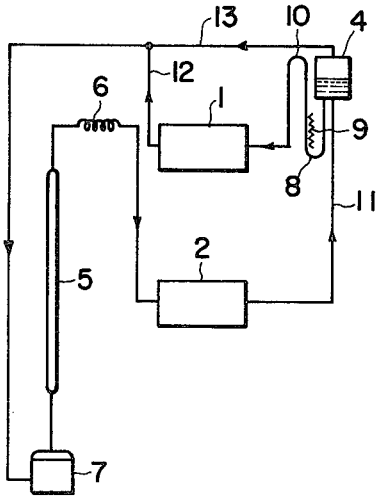

FIG. 6 shows another embodiment of a refrigerator according to the present invention.

In FIG. 6, the cooler 2 for the refrigerating compartment is included in the freezing cycle and the cooler 1 for the freezing compartment is included in the closed loop. Therefore, the heat transmitted by the cooler 1 is controlled.

Figure 7:
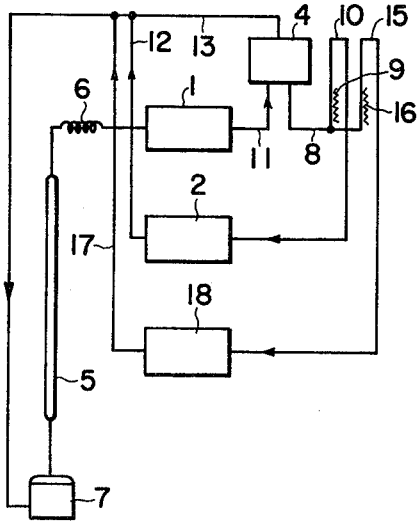
FIGS. 6 and 7 are diagrams showing other embodiments of a refrigerator according to the present invention.

FIG. 7 shows a further embodiment of a refrigerator according to the present invention.

In FIG. 7, a second heating device 16, a third cooler 18 for a third compartment and a connecting tube 17 are provided. A second closed loop branched from the refrigerating cycle is constituted by the third cooler 18, the connecting tube 17, the liquid tank 4 and the second heating device 16.

The second closed loop may be provided in the device shown in FIG. 6.

In FIGS. 6 and 7, three or more closed loops may be provided.

Furthermore, the examples shown in FIGS. 2 through 4, or modifications of these examples, may be adapted for the devices shown in FIGS. 5 through 7.

In FIGS. 2 through 4, it is not necessary that the height of the top of the inverted U-type tube 10 be higher than the liquid tank 4, if the volume of circulating refrigerant in the closed loop is effectively controlled by the heating device.

According to the embodiments of the present invention, since a mechanical portion such as an electromagnetic valve is completely unnecessary and a heating device is substituted therefor, there is realized a refrigerator which has a long lifetime, a high reliability and low cost.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim

1. A refrigerator comprising:

refrigerating cycle means including first cooling means and a liquid tank for charging a working fluid from said first cooling means;

at least one closed loop means branched from said refrigerating cycle means and including an inverted U-type tube in which working fluid flows from the inlet to the outlet by means of a vapor bubble pumping action, a first connecting tube for supplying the working fluid from said liquid tank to the inlet of said inverted U-type tube, a heating means disposed around the inlet of said inverted U-type tube, a second cooling means to which the working fluid is supplied from the outlet of said inverted U-type tube, and a second connecting tube for directly returning the working fluid from said second cooling means to said liquid tank.

2. A refrigerator according to claim 1, wherein said refrigerating cycle means includes a compressor for compressing the working fluid, a radiator for condensation of the working fluid compressed by said compressor and for supplying the condensation working fluid to said first cooling means, a connecting tube for feeding back the vapor evaporated by said first cooling means to said compressor.

3. A refrigerator according to claim 1, in which the height of the top portion of said inverted U-type tube is higher than that of the top surface of the working fluid in said liquid tank.

4. A refrigerator according to claim 1, in which said closed loop means further includes a third connecting tube for connecting the top portion of said inverted U-type tube with a portion of said second connecting tube.

5. A refrigerator according to claim 1, in which said closed loop means further includes a pressure-equalizing tube for connecting the top portion of said inverted U-type tube with said liquid tank.

6. A refrigerator according to claim 1, in which said closed loop means further includes a liquid trap being connected between said inverted U-type tube and said second cooling means.

7. A refrigerator according to claim 1, in which said at least one closed loop means comprises a plurality of closed loops.

8. A refrigerator according to claim 1, in which said first and second cooling means are provided in a freezing compartment and a refrigerating compartment, respectively.

9. A refrigerator according to claim 1, in which said first and second cooling means are provided in a refrigerating compartment and a freezing compartment, respectively.

10. A refrigerator comprising:

refrigerating cycle means including first cooling means for circulating a working fluid therein and a liquid tank for charging the working fluid from said first cooling means;

at least one closed loop means branched from said liquid tank of said refrigerating cycle means and including second cooling means and means for directly returning the working fluid from said second cooling means to said liquid tank; and at least one heating means provided in the closed loop means for controlling the volume of the working fluid supplied to the closed loop means;

wherein said closed loop means includes an inverted U-type tube between said liquid tank and said second cooling means; and wherein said at least one heating means is adjacent the inlet of said inverted U-type tube for effecting a vapor bubble pumping action.

11. A refrigerator comprising:

refrigerating cycle means including first cooling means for circulating a working fluid therein;

at least one closed loop means branched from said refrigerating cycle means and including second cooling means; and at least one heating means provided in the closed loop means for controlling the volume of the working fluid supplied to the closed loop means, wherein said refrigerating cycle means includes a liquid tank for charging the working fluid, and wherein said at least one closed loop means includes an inverted U-type tube connected between said liquid tank and said second cooling means, and a first connecting tube for returning the working fluid evaporated by said second cooling means to said liquid tank, said at least one heating means being provided between said liquid tank and said inverted U-type tube, and wherein said closed loop means further includes a second connecting tube for connecting the top portion of said inverted U-type tube with a portion of said first connecting tube.

* * * * *